US008385767B2

(12) United States Patent
Okada et al.

(10) Patent No.: US 8,385,767 B2
(45) Date of Patent: Feb. 26, 2013

(54) IMAGE FORMING APPARATUS INCLUDING A TRANSFER BELT UNIT, IMAGE FORMING UNITS, A SUPPORT MEMBER, AN AIR FLOW PATH FORMING MEMBER, AND AN EXHAUSTING UNIT

(75) Inventors: Masayuki Okada, Kanagawa (JP); Yutaka Nakayama, Kanagawa (JP); Kokichi Kasai, Kanagawa (JP); Akio Fukuyama, Kanagawa (JP); Yoshitaka Kuroda, Kanagawa (JP); Tetsuya Kawatani, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 330 days.

(21) Appl. No.: 12/700,854

(22) Filed: Feb. 5, 2010

(65) Prior Publication Data

US 2011/0008067 A1 Jan. 13, 2011

(30) Foreign Application Priority Data

Jul. 8, 2009 (JP) ..... 2009-161960

(51) Int. Cl.
*G03G 15/16* (2006.01)

(52) U.S. Cl. ..... 399/92

(58) Field of Classification Search ..... 399/92, 399/98, 93, 99, 317
See application file for complete search history.

(56) References Cited

U.S. PATENT DOCUMENTS

| | | | | |
|---|---|---|---|---|
| 4,080,053 | A * | 3/1978 | Friday | 399/317 |
| 6,308,024 | B1 * | 10/2001 | Nakayama et al. | 399/98 |
| 6,505,030 | B1 * | 1/2003 | Santiago et al. | 399/389 |
| 2010/0084803 | A1 * | 4/2010 | Akihiro et al. | 271/3.22 |

FOREIGN PATENT DOCUMENTS

| | | | |
|---|---|---|---|
| JP | 8171316 | A | 7/1996 |
| JP | 11349182 | A * | 12/1999 |
| JP | 2009258444 | A * | 11/2009 |

OTHER PUBLICATIONS

Computer translation for Kawakami et al., JP2009-258444A; Nov. 2009.*
Translation of JP11-349182A; Dec. 21, 1999 to Toshiyuki.*

* cited by examiner

*Primary Examiner* — Quana M Grainger
(74) *Attorney, Agent, or Firm* — Sughrue Mion, PLLC

(57) ABSTRACT

An image forming apparatus includes: a transfer belt having a surface onto which a toner image is transferred directly or through a transfer medium; plural image forming units that are aligned along a moving direction of the surface of the transfer belt and form the toner image; a support member that supports the transfer belt; a flow path forming member that forms a flow path along the moving direction of the surface of the transfer belt, has plural suction ports through which floating fine toner particles occurring in the plural image forming units are sucked into the flow path, and is disposed at the transfer belt side with respect to the support member; and an exhausting unit that sucks the floating fine toner particles through the suction ports into the flow path, and exhausts the sucked floating fine toner particles from the flow path.

11 Claims, 15 Drawing Sheets

IMAGE FORMING APPARATUS INCLUDING A TRANSFER BELT UNIT, IMAGE FORMING UNITS, A SUPPORT MEMBER, AN AIR FLOW PATH FORMING MEMBER, AND AN EXHAUSTING UNIT

CROSS-REFERENCE TO RELATED APPLICATIONS

This application is based on and claims priority under 35 USC 119 from Japanese Patent Application No. 2009-161960 filed Jul. 8, 2009.

BACKGROUND

Technical Field

The present invention relates to an image forming apparatus.

SUMMARY

According to an aspect of the present invention, there is provided an image forming apparatus including: a transfer belt unit that includes a transfer belt, the transfer belt having a surface onto which a toner image is transferred directly or through a transfer medium; a plurality of image forming units that are aligned along a moving direction of the surface of the transfer belt and form the toner image; a support member that supports the transfer belt unit; an air flow path forming member that forms an air flow path along the moving direction of the surface of the transfer belt, has a plurality of suction ports which are sucked into the air flow path, and is disposed at the transfer belt unit side with respect to the support member; and an exhausting unit that exhausts from the air flow path.

BRIEF DESCRIPTION OF THE DRAWINGS

An exemplary embodiment of the present invention will be described in detail based on the following figures, wherein.

DETAILED DESCRIPTION

An image forming apparatus according to an exemplary embodiment of the present invention will be described with reference to FIGS. 1 to 15.

(Overall Configuration)

Figure 4:
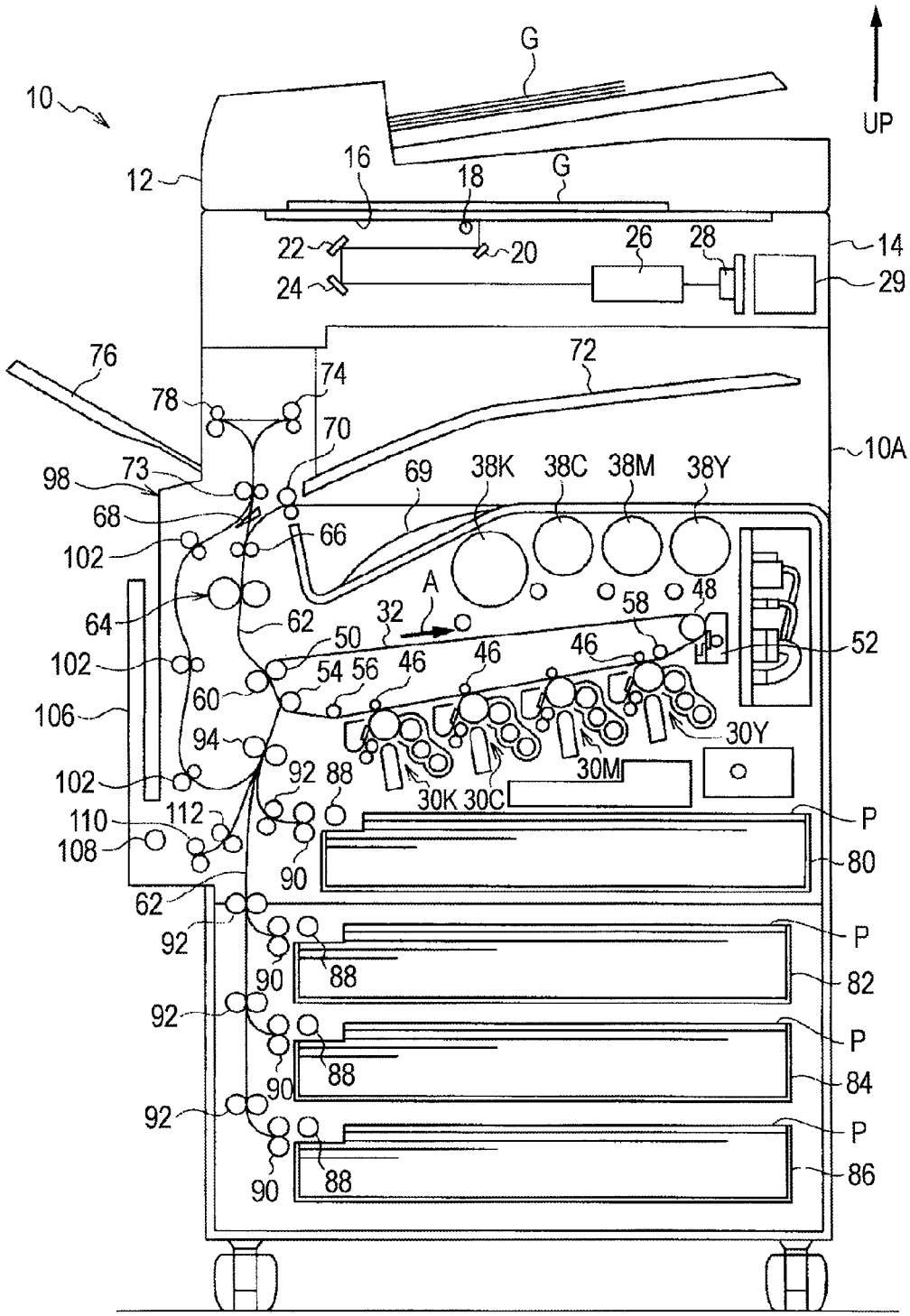
FIG. 4 is a schematic diagram showing the configuration of the image forming apparatus according to the exemplary embodiment of the present invention.

As shown in FIG. 4, the image forming apparatus 10 according to the exemplary embodiment of the present invention includes an automatic document feeder 12 for automatically feeding plural original documents G one by one, a platen glass 16 on which the original document G is put, and a document reading device 14 for reading the original document G fed by the automatic document feeder 12 or the original document G put on the platen glass 16 that are disposed at the upper portion of the main body 10A of the apparatus. An arrow UP in FIG. 4 represents an upward direction in the vertical direction, and an arrow FR represents an frontward direction (to a front side at which a user stands) (see FIGS. 4 and 5).

The document reading device 14 is equipped with a light source 18 for irradiating the original document G fed by the automatic document feeder 12 or the original document G put on the platen glass 16 with light.

The document reading device 14 is further equipped with an optical system including a full-rate mirror 20 for reflecting, in a direction parallel to the platen glass 16, reflection light that is reflected from the original document G when the original document G is irradiated with light from the light source 18, a half-rate mirror 22 for downwardly reflecting the reflection light reflected from the full-rate mirror 20, a half-rate mirror 24 for reflecting the reflection light reflected from the half-rate mirror 22 in a direction parallel to the platen glass 16 so that the reflection light from the half-rate mirror 22 is folded back, and an imaging lens 26 to which the reflection light folded back by the half-rate mirror 24 is incident.

The document reading device 14 is further provided with a photoelectric transducer 28 for converting the reflection light image-formed by the imaging lens 26 to an electrical signal, and an image processing apparatus 29 for executing image processing on the electrical signal converted by the photoelectric transducer 28.

The light source 18, the full-rate mirror 20, the half-rate mirror 22 and the half-rate mirror 24 are movable along the platen glass 16. When an original document G put on the platen glass 16 is read, the light source 18 irradiates the original document G put on the platen glass 16 with light and reflection light reflected from the original document G forms an image on the photoelectric transducer 28 while the light source 18, the full-rate mirror 20, the half-rate mirror 22 and the half-rate mirror 24 are moved.

Furthermore, when an original document G fed from the automatic document feeder 12 is read, the light source 18, the full-rate mirror 20, the half-rate mirror 22 and the half-rate mirror 24 are stopped at respective predetermined positions, the original document G fed from the automatic document feeder 12 is irradiated with light by the light source 18, and reflection light reflected from the original document G forms an image on the photoelectric transducer 28.

Plural image forming units 30 as an example of an image forming section for forming respective toner images of different colors are arranged side by side at the center portion in the vertical direction of the main body 10A of the apparatus so as to be inclined with respect to the horizontal direction. Furthermore, a transfer belt unit including an endless intermediate transfer belt 32 as an example of a transfer belt is provided at the upper side of the image forming units 30. Respective color toner images formed by the respective image forming units 30 are transferred onto the endless intermediate transfer belt 32 while the endless intermediate transfer belt 32 is driven to be circulated in the direction of an arrow A in FIG. 4.

Figure 3:
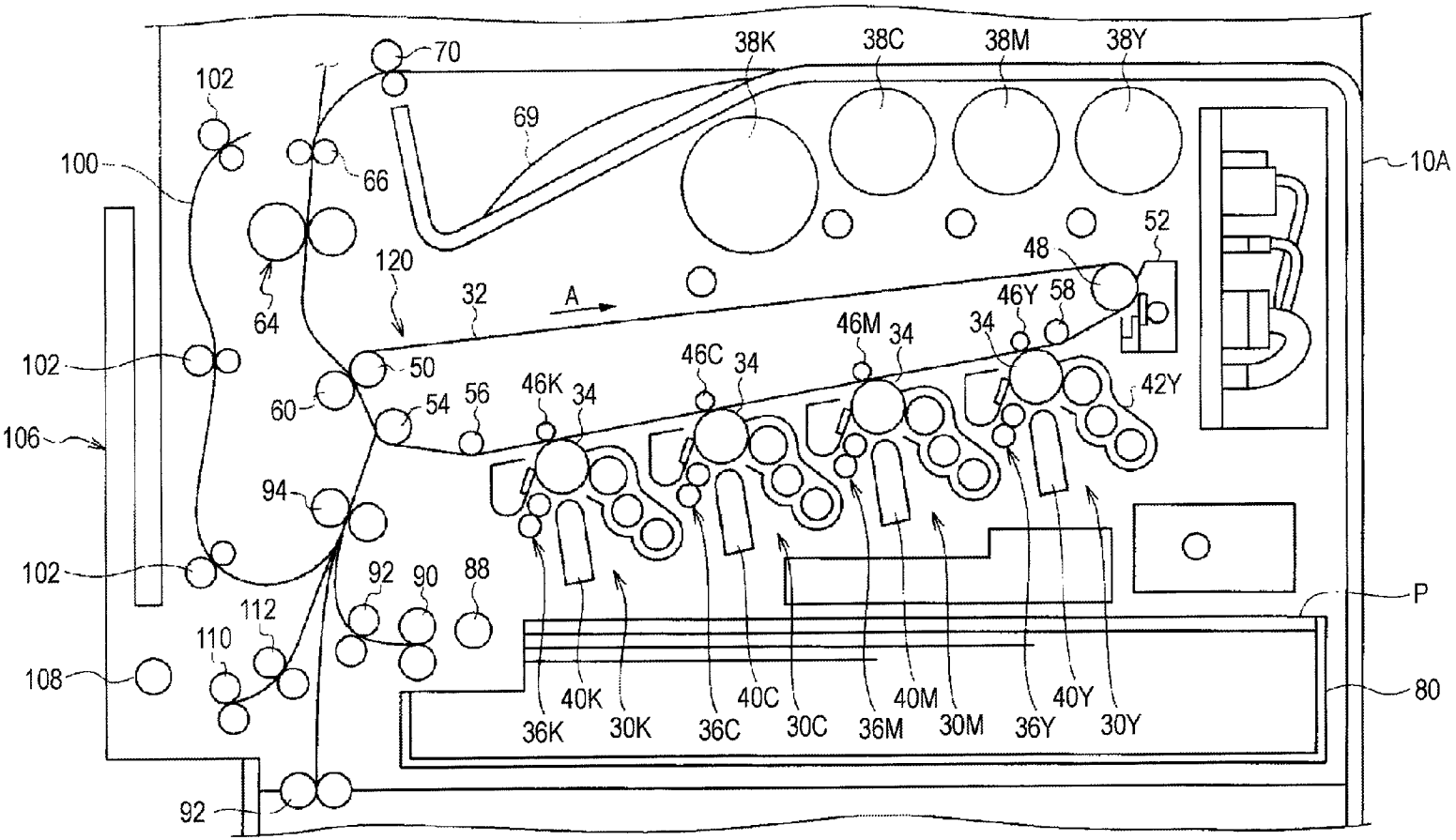
FIG. 3 is a schematic diagram showing the configuration of the surrounding of an intermediate transfer belt unit of the image forming apparatus according to the exemplary embodiment of the present invention.

More specifically, four image forming units 30Y, 30M, 30C and 30K of yellow (Y), magenta (M), cyan (C) and black (K) are disposed in this order as shown in FIG. 3. The image forming unit 30Y for forming a toner image of yellow (Y) that is first transferred onto the intermediate transfer belt 32 is disposed at the highest position, and the image forming unit 30K for forming a toner image of black (K) that is finally transferred onto the intermediate transfer belt 32 is disposed at the lowest position. The image forming units 30Y, 30M, 30C and 30K are arranged so as to be spaced from one another at a fixed interval while tilted obliquely to the horizontal direction at only a predetermined angle as a whole.

These four image forming units 30Y, 30M, 30C and 30K basically have the same configuration. In the following description, when the respective colors are discriminated from one another, characters (Y, M, C, K) corresponding to the respective colors are affixed to reference numerals, and when the respective colors are not particularly discriminated from one another, the characters corresponding to the respective colors are omitted.

Figure 2:
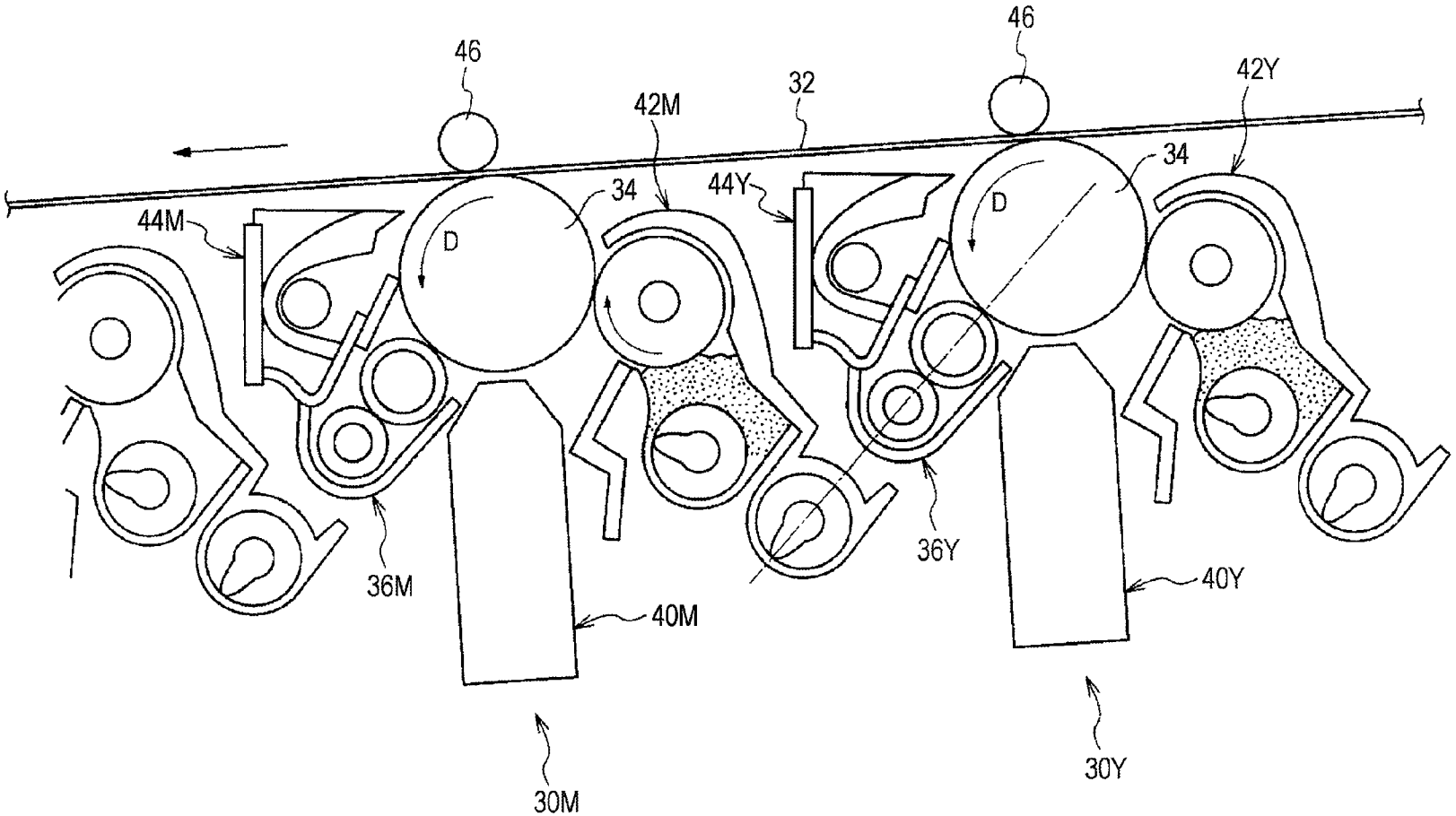
FIG. 2 is an enlarged front view showing an image forming unit used in the image forming apparatus according to the exemplary embodiment of the present invention.

As shown in FIG. 2, the image forming unit 30 of each color is provided with an image carrier 34 rotated in the direction of an arrow D by a driving unit (not shown), and further provided with a charging member 36 for uniformly electrifying the surface of the image carrier 34.

An exposure device 40 for applying light corresponding to a predetermined color to the surface of the image carrier 34 which has been uniformly charged by the charging member 36 to form an electrostatic latent image is provided at the downstream side in the rotational direction of the image carrier 34 with respect to the charging member 36. A developing unit 42 as an example of a developing member for developing the electrostatic latent image formed on the surface of the image carrier 34 with a toner of a predetermined color to visualize the electrostatic latent image as a toner image is also provided at the downstream side in the rotational direction of the image carrier 34 with respect to the exposure device 40.

A primary transfer member 46 for transferring the toner image formed on the surface of the image carrier 34 onto the intermediate transfer belt 32 is provided at the opposite side to the image carrier 34 so that the intermediate transfer belt 32 is sandwiched between the image carrier 34 and the primary transfer member 46. Furthermore, a cleaning device 44 for cleaning residual toner which is not transferred from the image carrier 34 to the intermediate transfer belt 32 and thus remains on the surface of the image carrier 34, etc. is provided at the downstream side in the rotational direction of the image carrier 34 with respect to the primary transfer member 46 so as to be in contact with the surface of the image carrier 34.

That is, the image forming unit 30 is configured to include the image carrier 34, the charging member 36, the exposure device 40, the developing unit 42 and the cleaning device 44.

Toner cartridges 38Y, 38M, 38C, 38K (see FIG. 4) for supplying toners of predetermined colors to the developing units 42 of respective colors of yellow (Y), magenta (M), cyan (c), black (K) are provided above the intermediate transfer belt 32. The toner cartridge 38K in which the toner of the black (K) color is stocked is frequently used, and thus it is designed to be larger than the toner cartridges of the other colors.

In the above configuration, image data of the respective colors are successively output from the image processing device 29 or an outside source to the exposure devices 40Y, 40M, 40C and 40K that are individually provided to the image forming units 30Y, 30M, 30C and 30K of the respective colors of yellow (Y), magenta (M), cyan (C) and black (K). The surface of each image carrier 34 is exposed to light emitted corresponding to the image data from corresponding one of the exposure devices 40Y, 40M, 40C and 40K, and an electrostatic latent image is formed on the surface of the image carrier 34. The electrostatic latent images formed on the surfaces of the image carriers 34 are developed into toner images of the respective colors of yellow (Y), magenta (M), cyan (C) and black (K) by the developing units 42Y, 42M, 42C and 42K, respectively.

The toner images of the respective colors of yellow (Y), magenta (M), cyan (C) and black (K) which are successively formed on the surfaces of the image carriers 34 are transferred and superposed onto the intermediate transfer belt 32 arranged aslope above the image forming units 30Y, 30M, 30C, 30K of the respective colors by the primary transfer members 46.

As shown in FIG. 3, under certain tension the intermediate transfer belt 32 is wound on a driving roll 48 for applying driving force to the intermediate transfer belt 32, a rotationally driven support roll 50, a tension applying roller 54 for applying tension to the intermediate transfer belt 32, a first idler roll 56 and a second idler roll 58.

Figure 15:
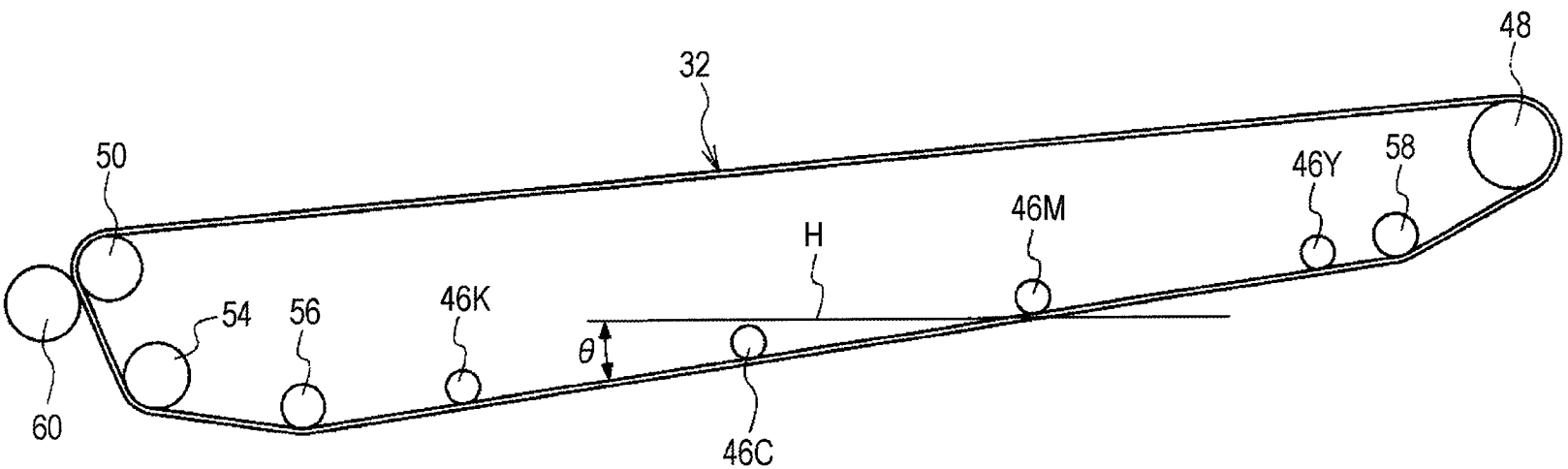
FIG. 15 is a front view showing the intermediate transfer unit used in the image forming apparatus according to the exemplary embodiment of the present invention.

As shown in FIG. 15, the lower surface of the intermediate transfer belt 32 is tilted with respect to the horizontal direction H by only an angle of θ as in the case of the tilt angle of the image forming units 30 (see FIG. 3) arranged aslope side by side.

Figure 6:
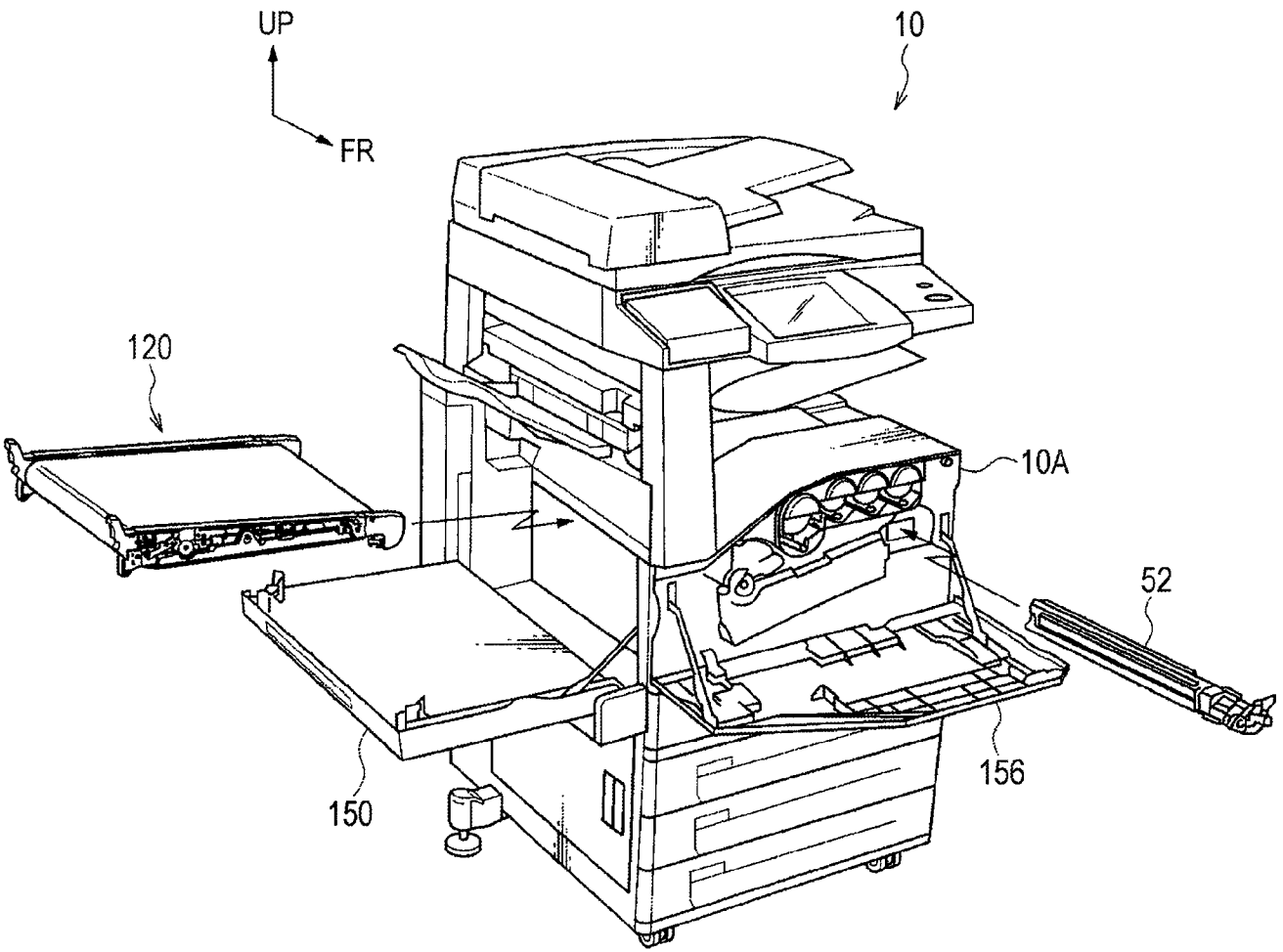
FIG. 6 is a perspective view showing the image forming apparatus according to the exemplary embodiment of the present invention.

A cleaning device 52 for cleaning the surface of the intermediate transfer belt 32 is provided at the opposite side to the driving roll 48 so that the intermediate transfer belt 32 is sandwiched between the cleaning device 52 and the driving roll 48, and the cleaning device 52 is freely attachable to and detachable from the apparatus main body 10A by opening a front cover 156 provided at the front side of the apparatus main body 10A (the front side at which a user stands) (see FIG. 6).

A secondary transfer member 60 for secondarily transferring a toner image primarily-transferred on the intermediate transfer belt 32 to a recording sheet P as a recording medium is disposed at the opposite side to the support roll 50 so that the intermediate transfer belt 32 is sandwiched between the secondary transfer belt 60 and the support roll 50. That is, the gap between the secondary transfer member 60 and the support roll 50 serves as a secondary transfer position at which a toner image is transferred onto a recording sheet P.

As shown in FIG. 4, a fixing device 64 for fixing a toner image onto a recoding sheet P is provided at the upper side of the secondary transfer member 60. That is, a toner image is transferred onto a recording sheet P by the secondary transfer 60, and then the recording sheet P is transported along a transporting path 62 to the fixing device 64 to fix the toner image on the recording sheet P.

A transporting roll 66 for transporting the recording sheet P having the toner image fixed thereon is provided at the downstream side in the transporting direction of the recording sheet P with respect to the fixing device 64 (hereinafter referred to as "at the downstream side in the transporting direction"), and a switching gate 68 for switching the transporting direction of the recording sheet P is provided at the downstream side in the transporting direction of the transporting roll 66.

A first discharge roll 70 is provided at the downstream side in the transporting direction of the switching gate 68, and a recording sheet P guided by the switching gate 68 which is switched to one side is discharged to a first discharge portion 69 by the first discharge roll 70.

A second discharge roll 74 and a third discharge roll 78 are further provided at the downstream side in the transporting direction of the switching gate 68. A recording sheet P which is guided by the switching gate 68 switched to the other side and then transported by a transporting roll 73 is discharged to a second discharge portion 72 by the second discharge roll, or discharged to a third discharge portion 76 by the third discharge roll 78.

Supply sheet trays 80, 82, 84 and 86 in which recording sheets P are stacked are provided at the lower portion of the apparatus main body 10A and also at the upstream side in the transporting direction of the recording sheet P with respect to the secondary transfer member 60 (hereinafter referred to as "the upstream side in the transporting direction"). Recording sheets P different in size are stacked in the respective supply sheet trays 80, 82, 84 and 86.

A sheet feed roll 88 is provided to each of the sheet feeders 80, 82, 84 and 86 to feed recording sheets P from the corresponding supply sheet tray (80, 82, 84, 86) into the transporting path 62, and transporting rolls 90 and 92 for successively transporting the recording sheets P one by one are provided at the downstream side in the transporting direction of each sheet feed roll 88.

Furthermore, a registration roll 94 for temporarily stopping each recording sheet P and feeding out it to the secondary transfer position at a predetermining timing is disposed at the downstream side in the transporting direction of the transporting roll 92.

Furthermore, in order to form images on both the sides of a recording sheet P, a reversible transporting unit 98 for reversing and transporting a recording sheet P is provided at the side of the secondary transfer position. The reversible transporting unit 98 is provided with a reversing path 100 in which a recording sheet P being transported by reversely rotating the transporting roll 73. Plural transporting rolls 102 are provided along the reversing path 100, and the recording sheet P is transported into the positioning roll 94 again by these transporting rolls 102 while both the sides thereof are reversed.

A foldable manual sheet feeder 106 is provided beside the reversible transporting unit 98, and a sheet feed roll 108 and transporting rolls 110 and 112 are provided to transport a recording sheet P fed from the opened foldable manual sheet feeder 106. A recording sheet P transported by the transporting rolls 110 and 112 is transported to the registration roll 94.

Next, the intermediate transfer unit 120 containing the intermediate transfer belt 32 as an constituent part will be described.

As shown in FIG. 3, the intermediate transfer unit 120 is configured to include the intermediate transfer belt 32, and the driving roll 48, the support roll 50, the tension applying roll 54, the first idler roll 56, the second idler roll 58 on which the intermediate transfer belt 32 is wound. The intermediate transfer unit 120 is attachable to and detachable from one side surface (the side surface of the left side shown in FIG. 3) of the apparatus main body 10A by opening a cover (not shown).

Figure 14A:
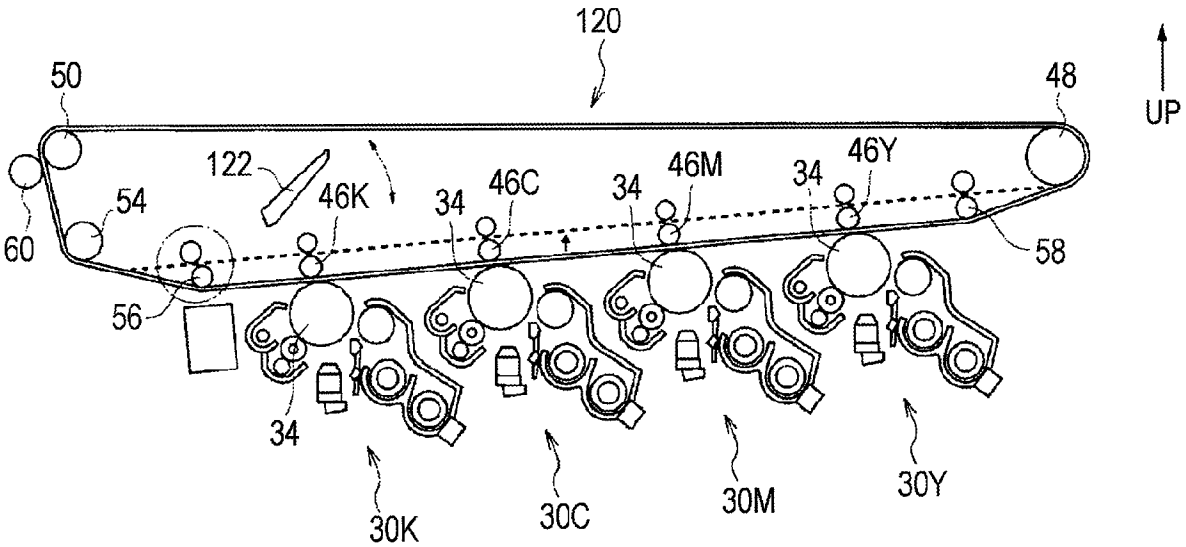
FIGS. 14A and 14B are front views showing the intermediate transfer unit used in the image forming apparatus according to the exemplary embodiment of the present invention.
Figure 14B:
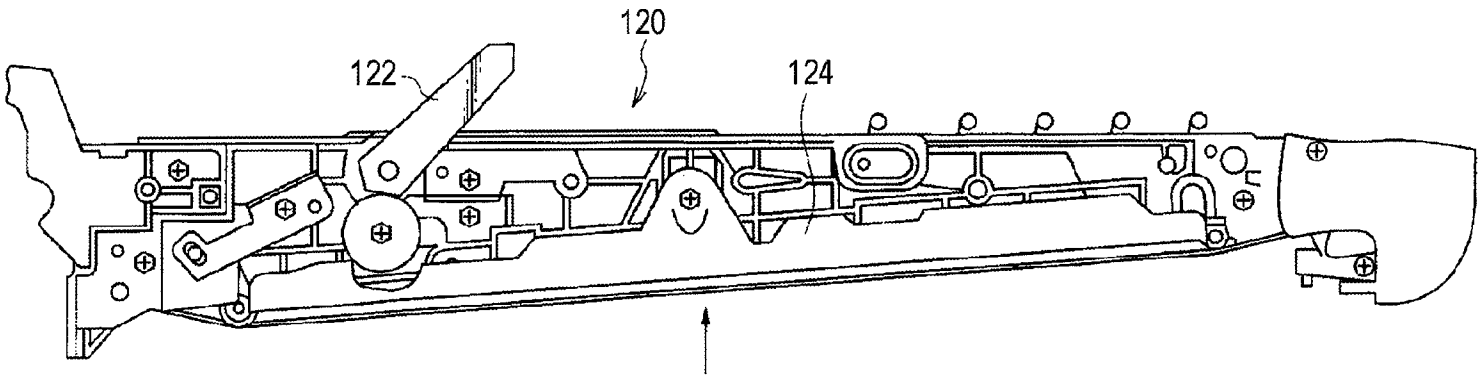

As shown in FIGS. 14A and 14B, the intermediate transfer unit 120 is provided with a retract handle 122. By rotating the retract handle 122, the first and second idler rolls 56 and 58 and the primary transfer members 46Y, 46M, 46C and 46K are upwardly retracted, and the intermediate transfer belt 32 is separated from the image carriers 34 of the image forming units 30Y, 30M, 30C and 30K of the respective colors.

Specifically, as shown in FIG. 14B, the retract handle 122 is secured to the intermediate transfer unit 120 so as to be freely turnable. Furthermore, a holding frame 124 on which the first idler roll 56, the second idler roll 58 and the primary transfer members 46Y, 46M, 46C and 46K are freely rotatably mounted is joined to the retract handle 122 through a link mechanism (not shown).

By turning the retract handle 122, the holding frame 124 is moved in a direction (the direction of an arrow in FIG. 14B) intersecting to the circulating direction of the intermediate transfer belt 32, and the intermediate transfer belt 32 is separated from the image carriers 34 of the respective colors by elastic force.

Figure 11:
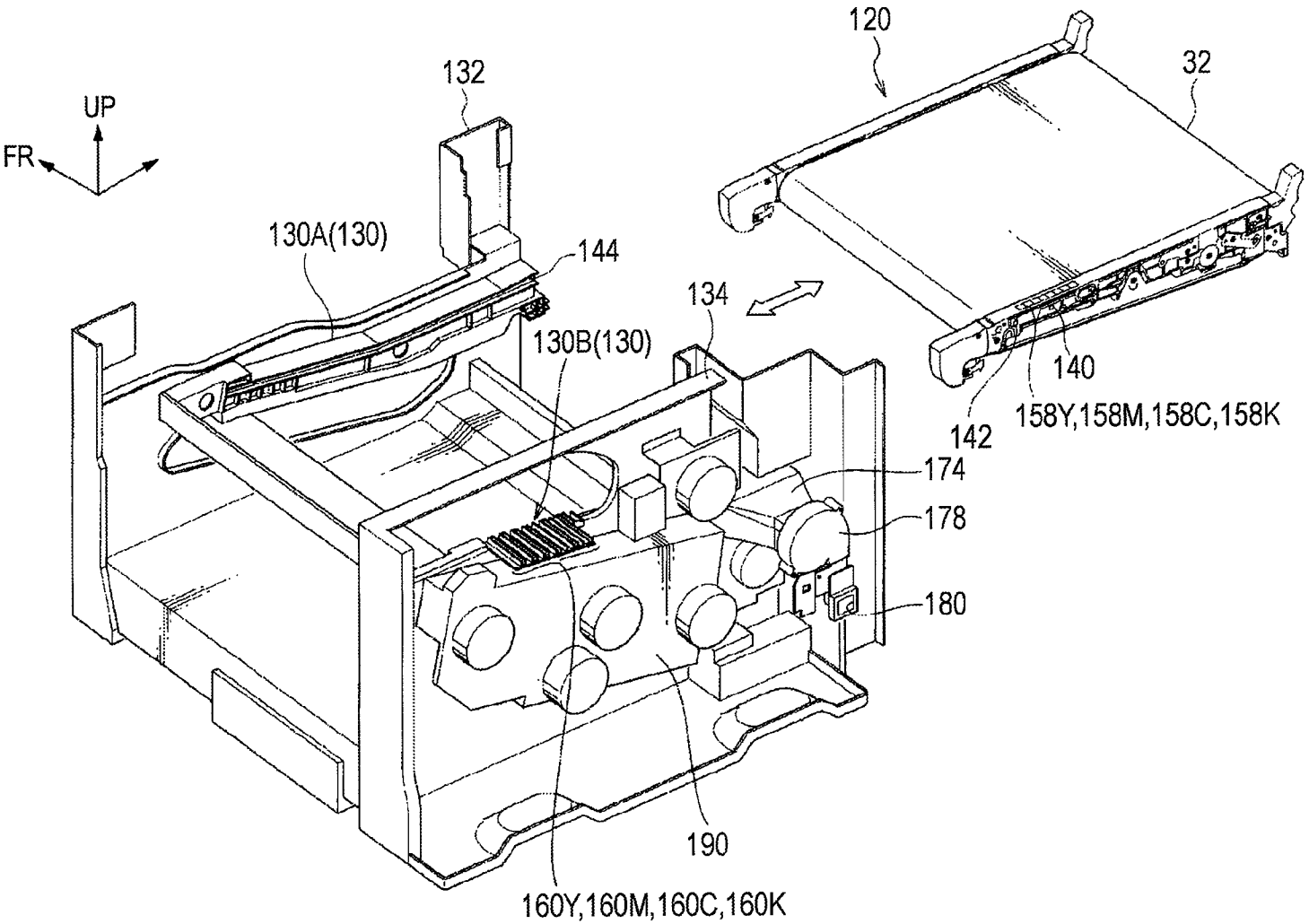
FIG. 11 is a perspective view showing the guide rail member, a front frame member, the rear frame member, an intermediate transfer unit, etc. used in the image forming apparatus according to the exemplary embodiment of the present invention.
Figure 12:
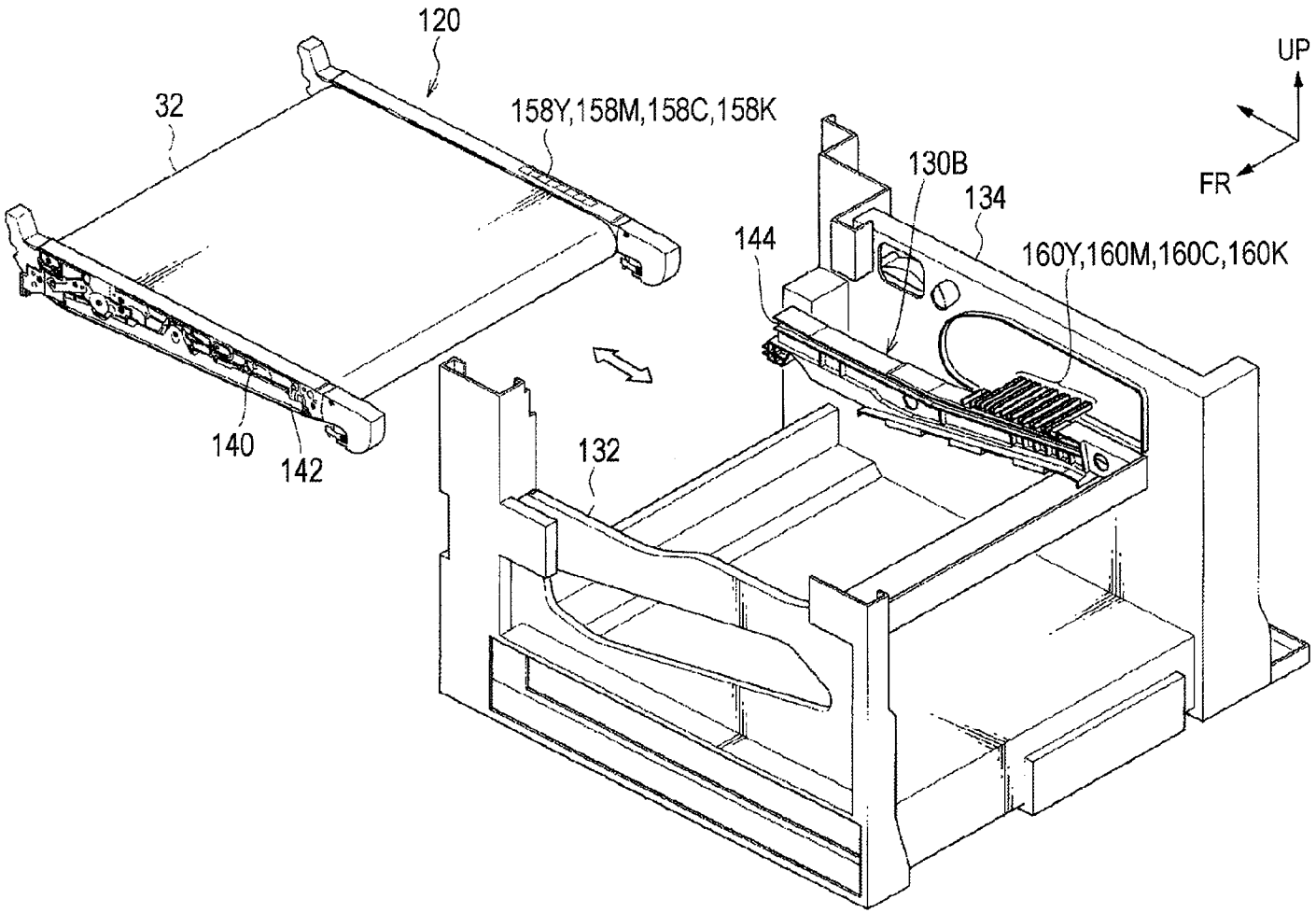
FIG. 12 is a perspective view showing the guide rail member, the front frame member, the rear frame member, the intermediate transfer unit, etc. used in the image forming apparatus according to the exemplary embodiment of the present invention.

Furthermore, a guide rail member 130 is provided in the apparatus main body 10A (see FIG. 3) as shown in FIGS. 11 and 12. The guide rail member 130 guides the intermediate transfer unit 120 which is attachable to/detachable from one side surface of the apparatus main body 10A, and supports the intermediate transfer unit 120 mounted in the apparatus main body 10A.

The guide rail member 130 has a guide rail member 130A mounted at the inside of a front frame member 132 (at the side where the intermediate transfer unit 120 is disposed) which is provided at the front side (at the front side where a user stands) and designed as a plate-shaped structural member, and a guide rail member 130B mounted at the inside of a rear frame member 134 which is provided at the rear side (at the back side where the user does not stand) and designed as a plate-shaped structural member.

Guide grooves 144 along which the intermediate transfer unit 120 is guided are formed in the guide rail members 130A and 130B, and the shapes of the guide grooves 144 are determined so as to change the guide direction of the intermediate transfer unit 120 halfway.

Figure 13A:
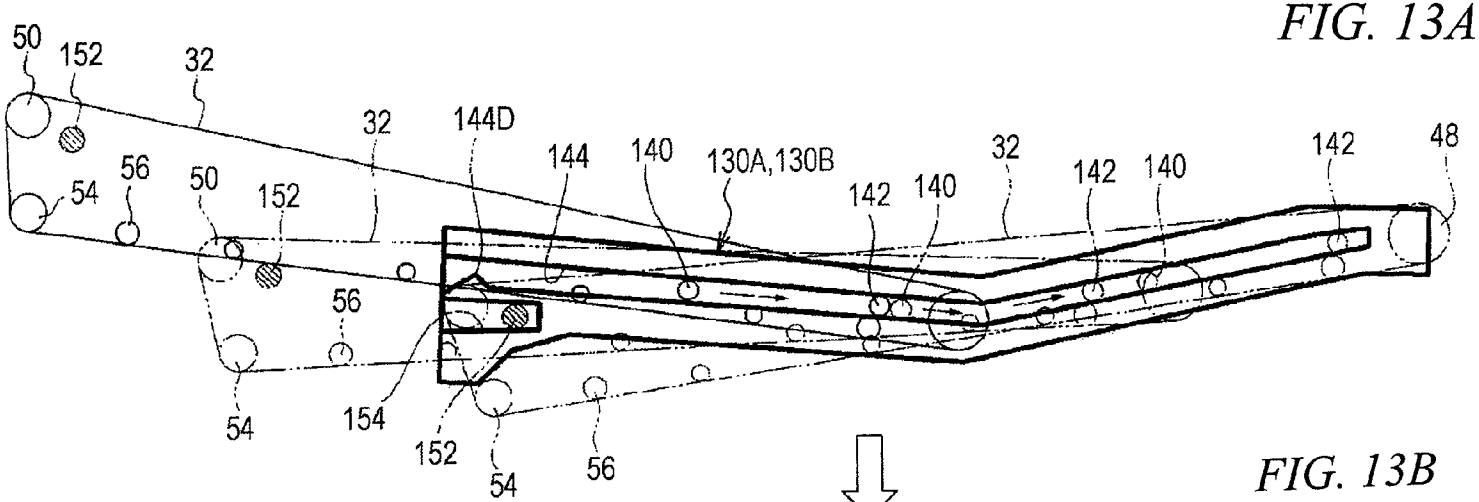
FIGS. 13A and 13B are diagrams showing a mounting operation of the intermediate transfer unit used in the image forming apparatus according to the exemplary embodiment of the present invention.
Figure 13B:
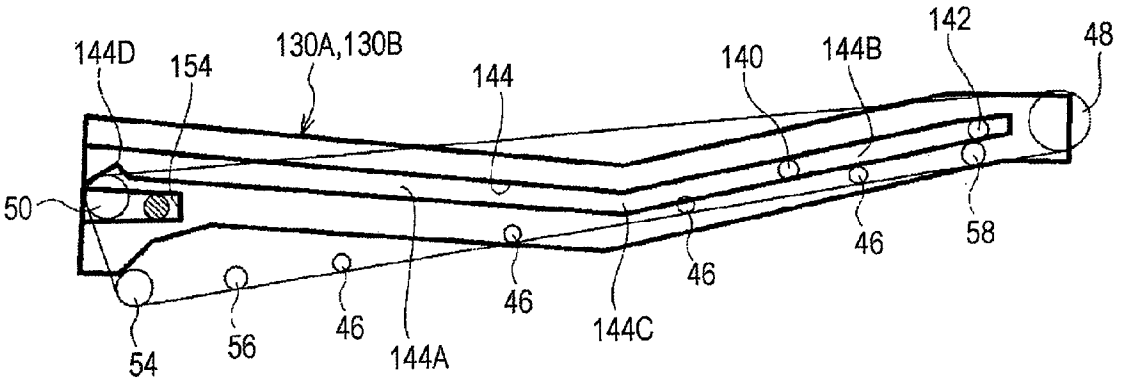

Specifically, as shown in FIGS. 13A and 13B, the guide grooves 144 formed in the guide rail members 130A and 130B guide two guide pins 140 and 142 provided to the intermediate transfer unit 120.

Each of the guide grooves 144 has a first site 144A that is sloped so that the end portion of the attaching/detaching side (the left side of the paper surface of FIGS. 13A and 13B) is slightly higher, a second site 144B that is sloped so that the end portion of the back side (the right side of the paper surface of FIGS. 13A and 13B) is located at a predetermined height with respect to the horizontal direction, and a bent portion 144C at which the first site 144A and the second site 144B are joined to each other.

In the above construction, when the intermediate transfer unit 120 is mounted in the apparatus main body 10A, the retract handle 122 is first rotated to retract the first idler roll 56, the second idler roll 58 and the primary transfer members 46Y, 46M, 46C and 46K from the image carriers 34 as shown in FIGS. 6, 13 and 14.

Figure 5:
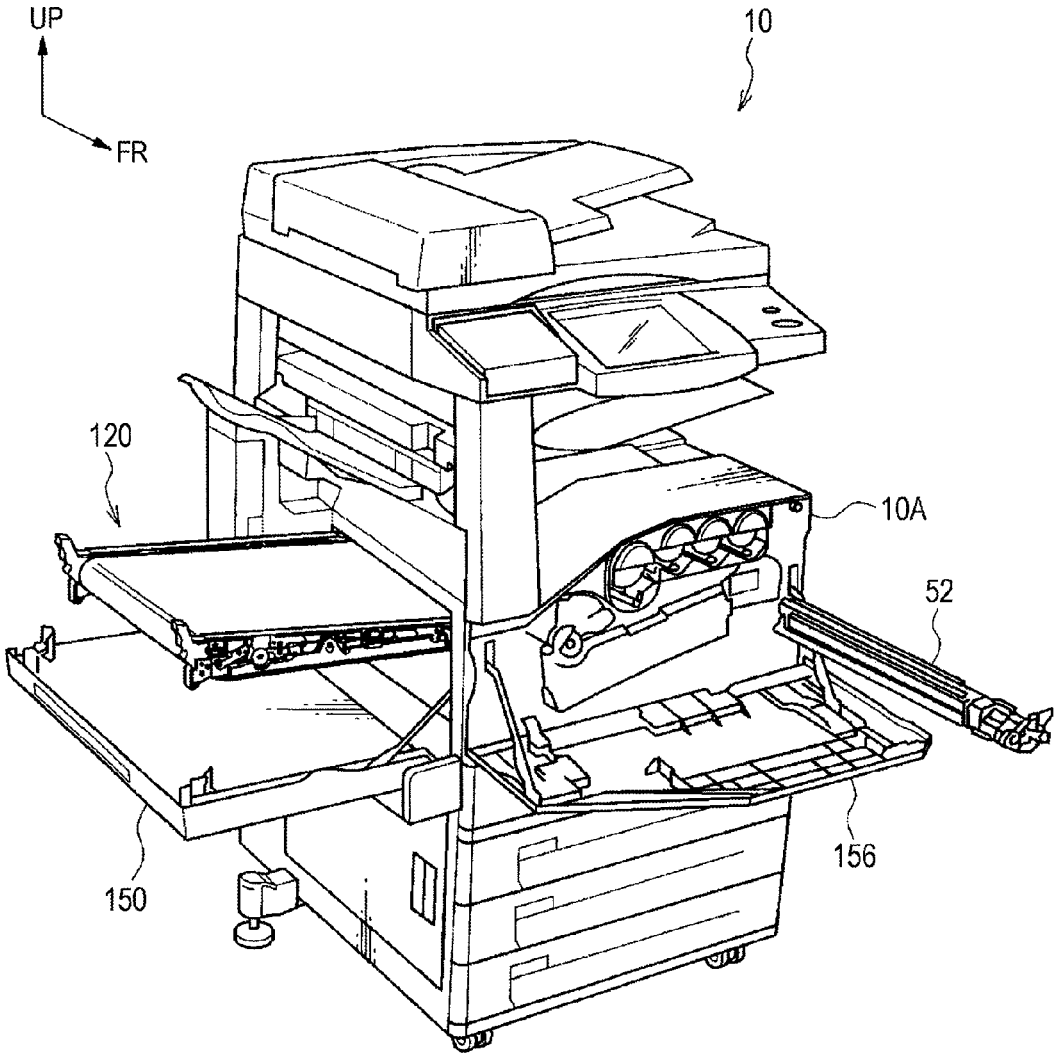
FIG. 5 is a perspective view showing the image forming apparatus according to the exemplary embodiment of the present invention.

Furthermore, the two guide pins 140 and 142 of the intermediate transfer unit 120 are inserted into the guide grooves 144 of the guide rail members 130A and 130B in a state that a side surface cover 150 provided to the side surface of the apparatus main body 10A is open. Thereafter, the intermediate transfer unit 120 is pushed into the apparatus main body 10A as shown in FIG. 5. Accordingly, the two guide pins 140 and 142 of the intermediate transfer unit 120 are guided along the guide grooves 144 of the guide rail members 130A and 130B as shown in FIGS. 13A and 13B. A chevron-shaped projection 144D is formed at the attaching/detaching side of each guide groove 144 (entrance side), whereby the guide pins 140 and 142 of the intermediate transfer unit 120 are prevented from dropping off from the guide grooves 144.

Furthermore, in a state that the mounting of the intermediate transfer unit 120 in the apparatus main body 10A is completed, a positioning pin 152 provided to the intermediate transfer unit 120 is fitted into positioning grooves 154 formed in the guide rail members 130A and 130B, thereby stabilizing the attitude of the intermediate transfer unit 120 when the mounting is completed.

The retract handle 122 is rotated to make the primary transfer members 46Y, 46M, 46C and 46K abut against the confronting image carriers 34 through the intermediate transfer belt 32, whereby the mounting work of the intermediate transfer unit 120 is completed. When the intermediate transfer unit 120 is detached from the apparatus main body 10A, the work may be executed in the reverse process to the mounting work.

Furthermore, the intermediate transfer unit 120 is provided with plural power supply units 158Y, 158M, 158C and 158K at the guide rail member 130B side as shown in FIG. 11. Under the state that the intermediate transfer unit 120 is mounted in the apparatus main body 10A, the plural power supply units 158Y, 158M, 158C and 158K are brought into electrical contact with power supply units 160Y, 160M, 160C and 160K provided to the guide rail member 130B, whereby power can be supplied. Accordingly, power is supplied from the power supply units 160Y, 160M, 160C and 160K to the primary transfer members 46Y, 46M, 46C and 46K provided to the intermediate transfer unit 120 by the plural power supply units 158Y, 158M, 158C and 158K.

(Configuration of Main Parts)

Figure 1:
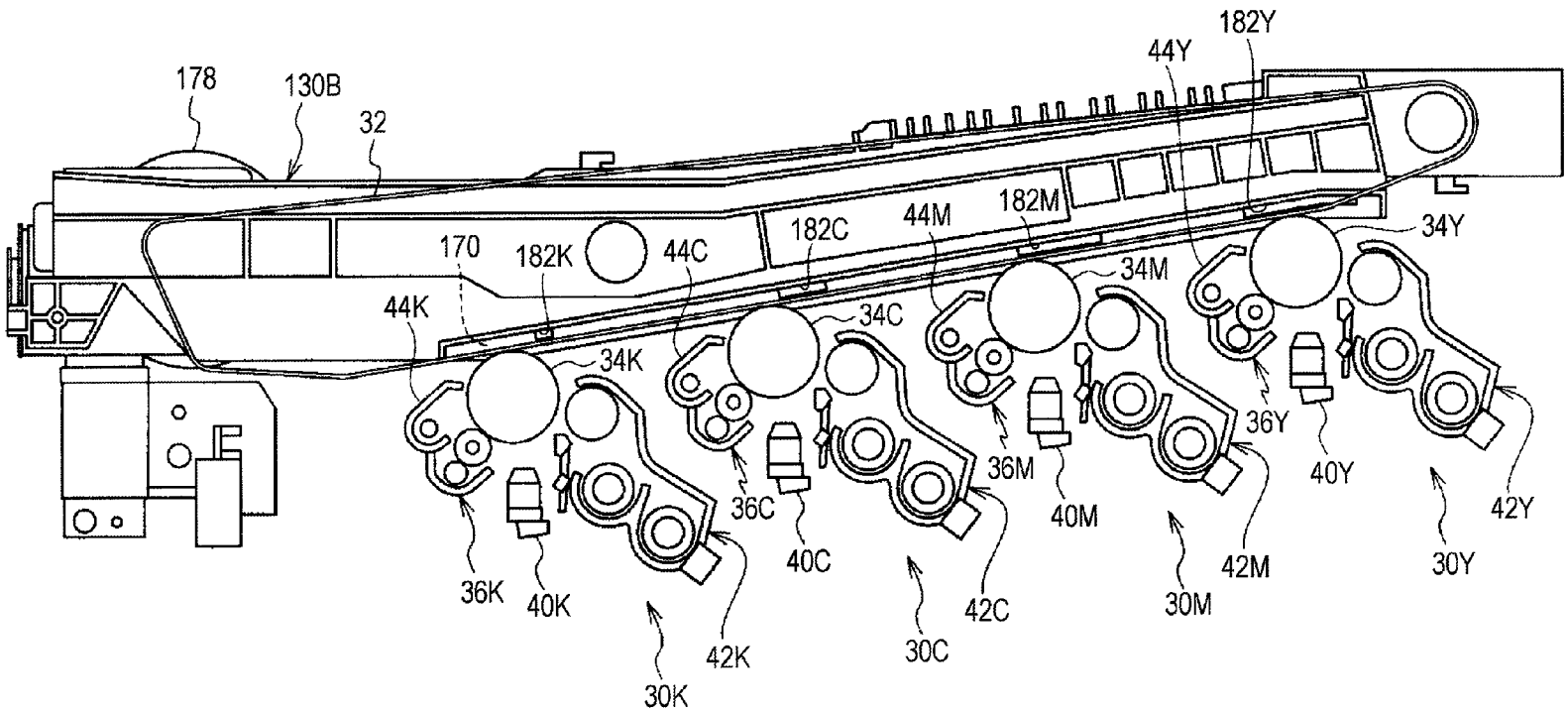
FIG. 1 is a front view showing a guide rail, etc. used in an image forming apparatus according to an exemplary embodiment of the present invention.
Figure 7:
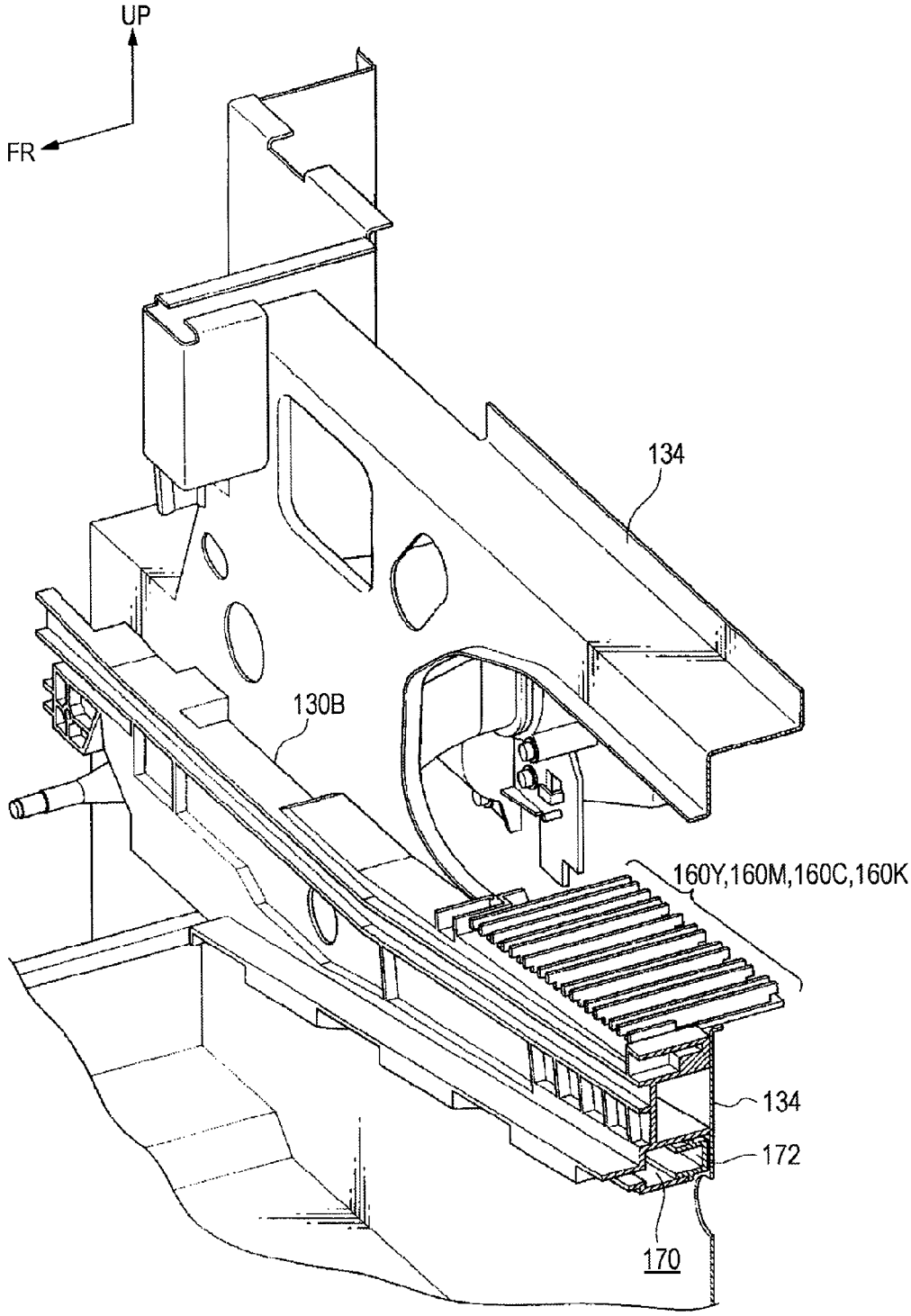
FIG. 7 is a perspective view showing a guide rail member, a rear frame member, etc. used in the image forming apparatus according to the exemplary embodiment of the present invention.
Figure 10:
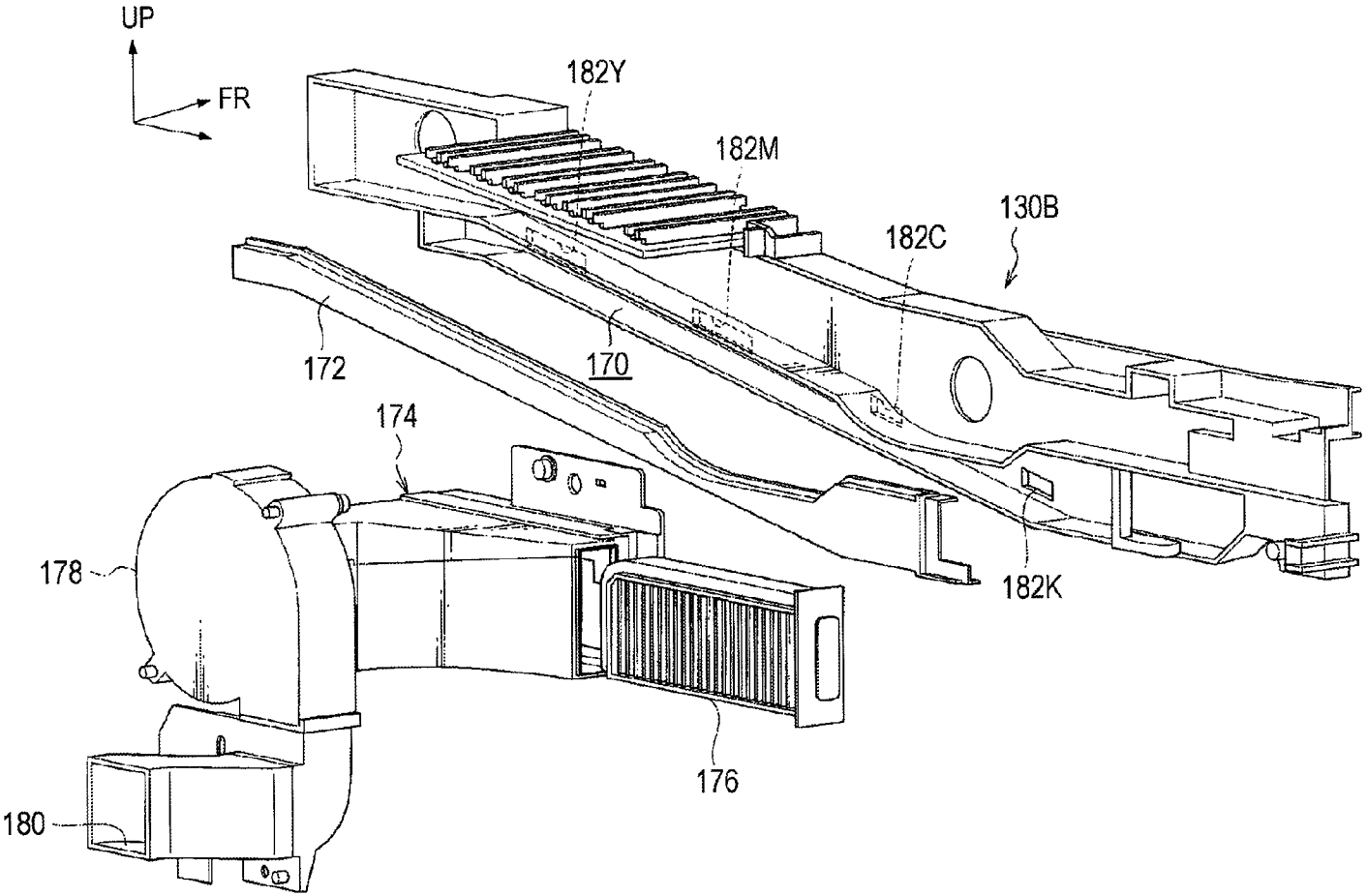
FIG. 10 is a perspective view showing the guide rail member, the cover member, the fan, etc. used in the image forming apparatus according to the exemplary embodiment of the present invention.

As shown in FIG. 10, a recessed air flow path 170 opened at the rear frame member 134 (see FIG. 11) side is provided to the guide rail member 130 of the rear side (the back side at which the user does not stand) so as to extend along the moving direction of the intermediate transfer belt 32 (see FIG. 1). Furthermore, a cover member 172 that covers the recessed air flow path 170 from the rear frame member 134 (see FIG. 11) side so as to prevent air flowing in the air flow path 170 from leaking to the outside is provided to the guide rail member 130B. That is, as shown in FIG. 7, the flow path 170 is covered by the cover member 172, and disposed at the intermediate transfer belt 32 (see FIG. 11) side of the rear frame member 134.

In this example, the air flow path 170 is provided to the guide rail member 130B. However, the air flow path 170 may be a member separate from the guide rail member 130B insofar as the member serves as a passage through which air flows along the moving direction of the intermediate transfer belt 32.

Figure 9:
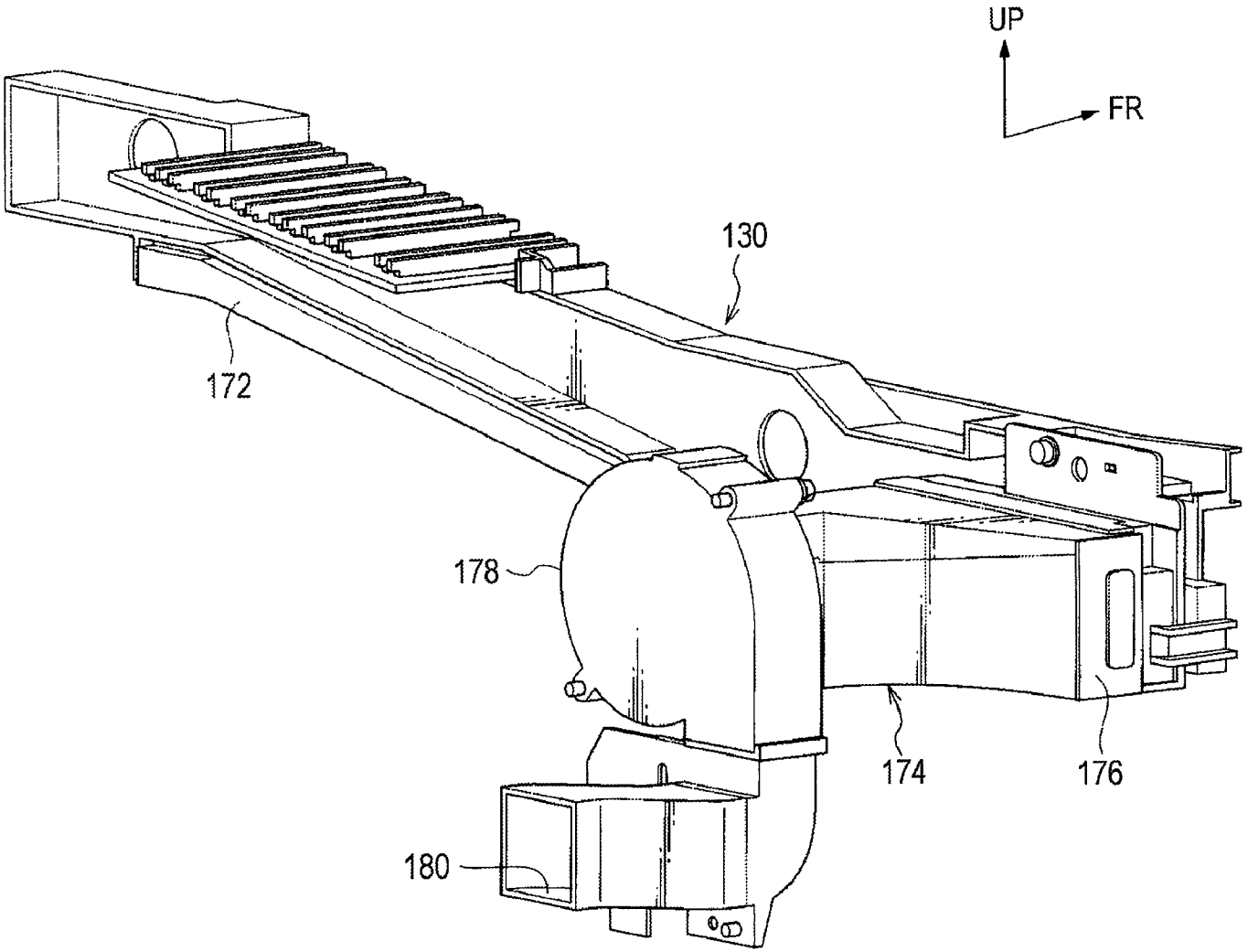
FIG. 9 is a perspective view showing the guide rail member, a cover member, a fan, etc. used in the image forming apparatus according to the exemplary embodiment of the present invention.

As shown in FIGS. 9 and 10, one end portion of the flow path 170 is not covered by the cover member 172 and thus it is opened, and a guide member 174 is joined to the opened portion of the flow path 170 at one end portion thereof, and leads air flowing through the flow path 170 to the rear side of the apparatus main body 10A (the back side at which the user does not stand).

Figure 8:
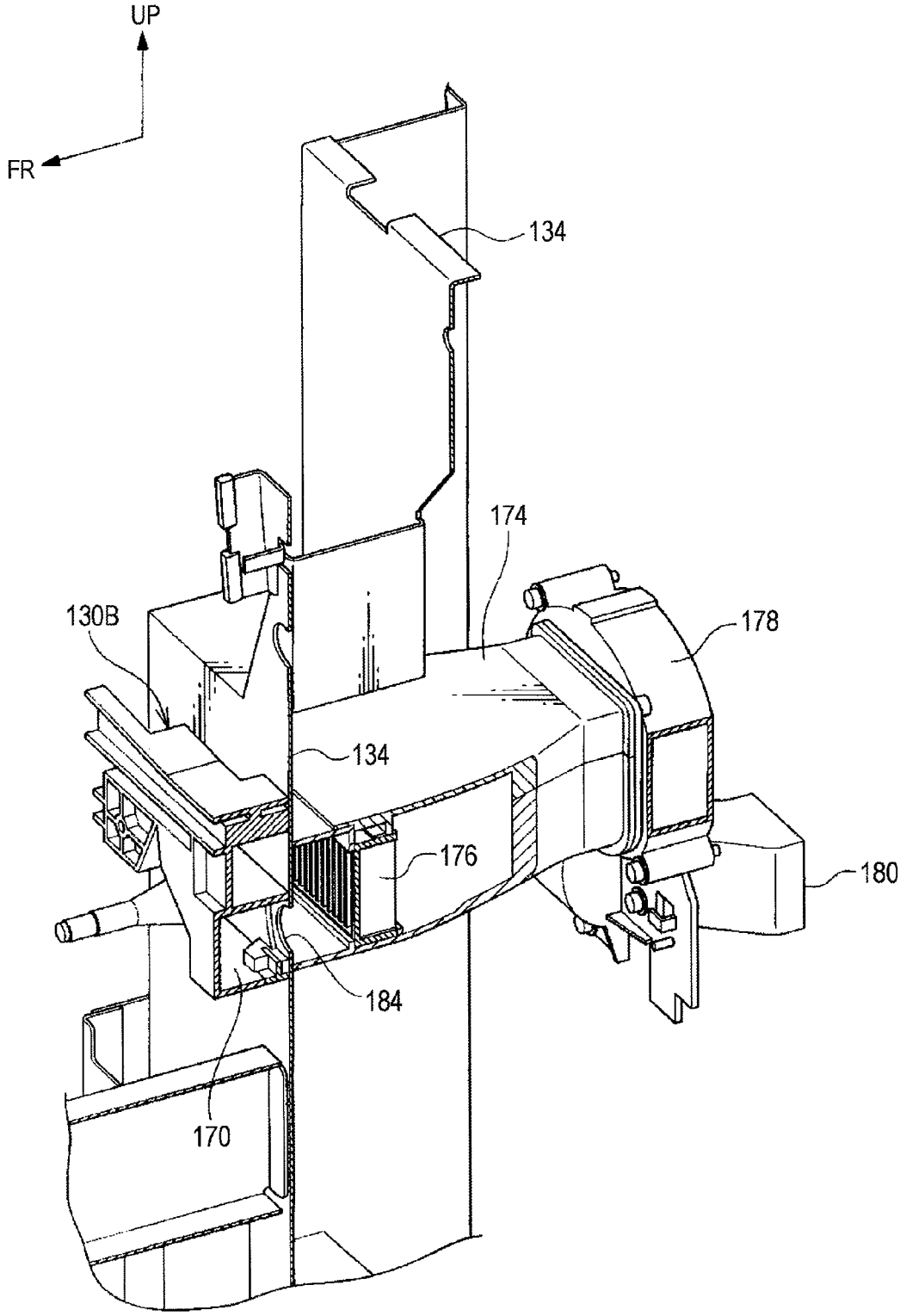
FIG. 8 is a perspective view showing the guide rail member, the rear frame member, etc. used in the image forming apparatus according to the exemplary embodiment of the present invention.

Specifically, the guide member 174 is provided at the rear side of the rear frame member 134 as shown in FIG. 11, and the air flowing through the flow path 170 flows into the guide member 174 through an opening 184 formed in the rear frame member 134 as shown in FIG. 8.

Furthermore, a filter member 176 for catching particles in air flowing through the flow path 170 is freely detachably mounted in the guide member 174 as shown in FIGS. 9 and 10. A fan 178 for sucking air from the flow path 170 and exhausting the sucked air through a vent 180 to the outside of the apparatus main body 10A is provided at the other end portion of the guide member 174. The vent 180 is disposed beside the fan 178.

As shown in FIG. 11, the fan 178 is provided at the one end portion of the flow path 170, thereby preventing interference between a gear member 190 for transmitting driving force to the image forming unit 30 of each color and the fan 178.

On the other hand, as shown in FIG. 1, a suction port 182 is formed in the wall surface (at the intermediate transfer belt 32 side) of the guide rail member 130B constituting the flow path 170. Floating fine toner particles (hereinafter referred to as "toner cloud") floating in the space surrounded by the image carrier 34, the developing unit 42 and the intermediate transfer belt 32 is sucked through the suction port 182 into the flow path 170. That is, the suction port 182 is provided at an air suction position of the space surrounded by the image carrier 34, the developing unit 42 and the intermediate transfer belt 32.

Specifically, the guide rail member 130B is provided with a suction port 182Y for sucking toner cloud floating in the space surrounded by the image carrier 34Y, the developing unit 42Y and the intermediate transfer belt 32, a suction port 182M for sucking toner cloud floating in the space surrounded by the image carrier 34M, the developing unit 42M and the intermediate transfer belt 32, a suction port 182C for sucking toner cloud floating in the space surrounded by the image carrier 34C, the developing unit 42C and the intermediate transfer belt 32, and a suction port 182K for sucking toner cloud floating in the space surrounded by the image carrier 34K, the developing unit 42K and the intermediate transfer belt 32.

The size of each of the suction ports 182Y, 182M, 182C and 182K is determined in accordance with the distance from the fan 178. That is, the opening area of the suction port 182Y located at the most remote position from the fan 178 is set to be largest, and the opening area of the suction port is successively reduced as the suction port approaches the fan 178.

That is, the suction power of the fan 178 at the suction port 182Y is weakest because the suction port 182Y is farthest away from the fan 178, and thus the opening area of the suction port 182Y is set to the largest value. Rather, the suction power of the fan 178 at the suction port 182K is strongest because the suction port 182K is nearest to the fan 178, and thus the opening area of the suction port 182K is set to the smallest value.

As is apparent from the positional relationship of the guide rail member 130B, the intermediate transfer belt 32, the image carriers of the respective colors and the developing units 42 of the respective colors in FIG. 1, the driving roll 48, etc. of the intermediate transfer unit 120 are omitted from the illustration of FIG. 1.

(Behavior)

As shown in FIG. 3, the charging member 36 provided to the image forming unit 30 of each color uniformly charges the surface of the corresponding image carrier 34.

Furthermore, the image data of the respective colors are successively output to the exposure devices 40 that are individually provided to the image forming units 30 of the respective colors. The surface of each image carrier 34 is exposed to and scanned with light emitted from the corresponding exposure device 40 in accordance with the image data, and an electrostatic latent image is formed on the surface of the image carrier 34 by the primary transfer members 46.

The electrostatic latent images formed on the surfaces of the image carriers 34 are successively developed into toner images of respective colors of yellow (Y), magenta (M), cyan (C) and black (K) by the developing units 42 of the respective colors. The toner images of the respective colors of yellow (Y), magenta (M), cyan (c) and black (K) that are successively formed on the respective surfaces of the image carriers 34 of the respective colors are transferred and superposed onto the intermediate transfer belt 32.

When an electrostatic latent image formed on the surface of the image carrier 34 is developed into a toner image by the developing unit 42, and also when a toner image formed on the surface of the image carrier 34 is transferred onto the intermediate transfer belt 32, extra toner occurs as toner cloud in the space surrounded by the image carrier 34, the developing unit 42 and the intermediate transfer belt 32.

As shown in FIGS. 7, 9 and 10, the fan 178 sucks air flowing through the flow path 170 and exhausts the air from the vent 180 (see FIG. 11). As shown in FIG. 1, the fan 178 sucks the air in the flow path 170, whereby suction force for sucking air in the space surrounded by the image carrier 34, the developing unit 42 and the intermediate transfer belt 32 occurs in the suction ports 182Y, 182M, 182C and 182K formed in the wall surface of the flow path 170.

The toner cloud floating in the space surrounded by the image carrier 34 of each color, the developing unit 42 of each color and the intermediate transfer belt 32 is sucked from each of the suction ports 182Y, 182M, 182C and 182K into the flow path 170 and captured by the filter member 176, and then air containing no toner is exhausted from the vent 180 to the outside by the suction force occurring in the suction ports 182Y, 182M, 182C, and 182K.

As described above, the toner cloud occurring in the plural image forming units 30 arranged along the intermediate transfer belt 32 is discharged from the flow path 170 formed along the intermediate transfer belt 32.

That is, the suction port 182 is formed at an air suction position in the space surrounded by the image carrier 34, the developing unit 42 and the intermediate transfer belt 32. Therefore, the toner cloud floating in the space surrounded by the image carrier 34 of each color, the developing unit 42 of each color and the intermediate transfer belt 32 is sucked from each suction port 182 into the flow path 170 by the suction force occurring in the suction port 182, passed through the flow path 170 and then discharged to the outside of the flow path 170.

Furthermore, the opening area of the suction port 182Y at which the suction force of the fan 178 is weakest is set to the largest value, and the opening area of the suction port 182K at which the suction force of the fan 178 is strongest is set to the smallest value, whereby the toner clouds occurring in the image forming units 30 of the respective colors are sucked from the respective suction ports 182 all over (the suction amounts of air from the respective suction ports 182 can be approached to a fixed value).

Increase in size of the rear side of the apparatus main body 10A is suppressed by providing the flow path 170 at the intermediate transfer belt 32 side of the rear frame member 134.

The number of parts is reduced by providing the flow path 170 to the guide rail member 130B.

As compared with a case where an air intake duct is provided over the whole width of the developing unit, toner cloud occurring in the image forming unit 30 can be discharged to the outside of the flow path 170 by utilizing a smaller space.

Furthermore, by providing the fan 178 at one end portion of the flow path 170, the fan 178 is disposed without interfering with the gear member 190.

The present invention is not limited to the above exemplary embodiment, and various modifications may be made without departing from the subject matter of the present invention. For example, in the above exemplary embodiment, the toner cloud occurring in the image forming unit 30 of each color is sucked from each suction port 182 all over, however, the toner cloud may be sucked from each suction port all over by changing the cross-sectional area of the flow path 170 to adjust the suction force of each suction port 182.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chose and described in order to best explain the skilled in the air to understand the invention for various embodiments and with the various modifications as are suited to the particular use contemplated. It is intended that the scope of the invention be defined by the following claims and their equivalents.

What is claimed is:

1. An image forming apparatus, comprising:

a transfer belt unit that includes a transfer belt, the transfer belt having a surface onto which a toner image is transferred directly or through a transfer medium;

a plurality of image forming units that are aligned along a moving direction of the surface of the transfer belt and form the toner image;

a support member that supports the transfer belt unit;

an air flow path forming member that forms an air flow path along the moving direction of the surface of the transfer belt, and is disposed at the transfer belt unit side with respect to the support member, such that air is sucked from a plurality of suction ports into the air flow path; and an exhausting unit that exhausts the air from the air flow path.

2. The image forming apparatus according to claim 1, wherein floating fine toner particles occurring in the plurality of image forming units are sucked into the air flow path through the plurality of suction ports.

3. The image forming apparatus according to claim 1, wherein the air flow path forming member is fixed to the support member, and holds and positions the transfer belt unit.

4. The image forming apparatus according to claim 1, wherein the exhausting unit is provided at an end side of the air flow path forming member, and a size of each of the plurality of suction ports is varied according to a distance from the exhausting unit.

5. An image forming apparatus comprising:

a transfer belt unit that includes a transfer belt, the transfer belt having a surface onto which a toner image is transferred directly or through a transfer medium;

a plurality of image forming units aligned along a moving direction of the surface of the transfer belt, each of the image forming units including an image carrier having a surface on which an electrostatic latent image is formed, and a developing member that visualizes the electrostatic latent image formed on the surface of the image carrier to form the toner image that is transferred onto the surface of the transfer belt directly or through the transfer medium;

a support member that supports the transfer belt unit;

an air flow path forming member that forms an air flow path along the moving direction of the surface of the transfer belt, and is disposed at the transfer belt unit side with respect to the support member, such that air is sucked from a plurality of suction ports into the air flow path; and an exhausting unit that exhausts the air from the air flow path.

6. The image forming apparatus according to claim 5, wherein air in a space surrounded by the transfer belt, the image carrier and the developing member is sucked into the air flow path through the plurality of suction ports.

7. The image forming apparatus according to claim 5, wherein the air flow path forming member is fixed to the support member, and holds and positions the transfer belt unit.

8. The image forming apparatus according to claim 5, wherein the exhausting unit is provided at an end side of the air flow path forming member, and a size of each of the plurality of suction ports is varied according to a distance from the exhausting unit.

9. The image forming apparatus according to claim 1, wherein the air is sucked from the plurality of suction ports by the exhausting unit.

10. The image forming apparatus according to claim 1, wherein the exhausting unit is provided at an end side of the air flow path forming member, and a first suction port, which is closer to the exhausting unit than suction ports other than the first suction port, has a smaller size than a second suction port, which is further from the exhausting unit than the first suction port.

11. The image forming apparatus according to claim 10, wherein the second suction port is furthest from the exhausting unit, in comparison to suction ports other than the second suction port.

* * * * *